US007289742B2

(12) United States Patent
Nagata

(10) Patent No.: US 7,289,742 B2
(45) Date of Patent: Oct. 30, 2007

(54) PRINTING APPARATUS WITH REMOVABLE IMAGE FORMING SECTION AND POSITION ERROR PROCESSING OF IMAGE FORMING SECTION INSTALLATION POSITION

(75) Inventor: Masato Nagata, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/978,010

(22) Filed: Oct. 29, 2004

(65) Prior Publication Data

US 2005/0111859 A1 May 26, 2005

(30) Foreign Application Priority Data

Nov. 21, 2003 (JP) ..... 2003-391795

(51) Int. Cl.
*G03G 15/00* (2006.01)

(52) U.S. Cl. ..... 399/12; 399/13

(58) Field of Classification Search ..... 399/12, 399/13, 28, 53, 223; 347/43, 140
See application file for complete search history.

(56) References Cited

U.S. PATENT DOCUMENTS 6,029,018 A * 2/2000 Rogers et al. ..... 399/12
6,308,018 B1 * 10/2001 Yoshida et al. ..... 399/53
6,324,352 B1 * 11/2001 Suzuki ..... 399/13
6,490,422 B2 * 12/2002 Harumoto ..... 399/27
6,498,905 B1 * 12/2002 Tsuruya ..... 399/12
6,805,430 B2 * 10/2004 Chen et al. ..... 347/43
6,915,094 B2 * 7/2005 Tsuruya et al. ..... 399/12 X
6,931,228 B2 * 8/2005 Tanaka et al. ..... 399/13 X
6,996,346 B2 * 2/2006 Ito ..... 399/12
2004/0008997 A1 1/2004 Yoshimoto

FOREIGN PATENT DOCUMENTS

JP 10-171199 A 6/1998
JP 2001-183886 A 7/2001
JP 2004-045698 A 2/2004

* cited by examiner

*Primary Examiner*—Sandra L. Brase
(74) *Attorney, Agent, or Firm*—Akin Gump Strauss Hauer & Feld LLP

(57) ABSTRACT

What is disclosed is a printer comprising a mechanism mounting section which is able to attach plural image forming sections; a color information obtaining section to obtain color information informing kind of coloring material contained in each of said plural image forming sections attached at each prescribed position of said mechanism mounting section, an image processing section to generate each image data corresponding to each of said plural image forming sections, based on said image information.

8 Claims, 10 Drawing Sheets

PRINTING APPARATUS WITH REMOVABLE IMAGE FORMING SECTION AND POSITION ERROR PROCESSING OF IMAGE FORMING SECTION INSTALLATION POSITION

BACKGROUND OF THE INVENTION

1. Field of the Invention

The present invention relates to a printing apparatus, such as electrophotographic printer, having plural image forming section.

2. Description of Related Art

A printing apparatus, such as electrophotographic printer, has an image processing section and an image forming section. In the image processing section, image information received from a host device, is transformed to image data. In the image forming section, photosensitive drum is charged negative with a charging roller. And, a electrostatic latent image of the image data mentioned above, is formed with LED head, on the photosensitive drum. On this electrostatic latent image, a toner image is formed with using a developing roller, a toner conveying roller, a developing blade etc. In this process, toner remained on the photosensitive drum, is removed with a cleaning equipment.

Moreover, in a printing apparatus, such as color electrophotographic printer, has above image forming apparatus of four, corresponding to each color of Y, M, C, K. These four image forming sections are installed at prescribed positions in the printing apparatus. To each of these four image forming sections, each image data of prescribed color is sent from the image processing section. Each of four image forming sections reproduces each image on a print sheet, based on each image data. In this way, a color image is reproduced. In this kind of conventional printing apparatus such as color electrophotographic printer, a technique for reproducing monochromic image effectively, is disclosed in public (c.f. JP2001-183886).

However, in the conventional technique, it is necessary for the printing apparatus to attach all of four image forming sections as each color of Y, M, C, K, at each prescribed position in the printing apparatus, even when, for example, a monochromic image is reproduced. Moreover, the prescribed position is limited fixedly beforehand. And, to change the position is difficult. Therefore, it is difficult to realize monochromic printing apparatus enabling continuous printing for a long time, or printing apparatus enabling continuous printing for a long time with only two colors.

SUMMARY OF THE INVENTION

The present invention is made to solve problems mentioned above, that is, to realize monochromic printing apparatus enabling continuous printing for a long time, or printing apparatus enabling continuous printing for a long time with only two colors.

According to one aspect of the present invention, there is provided a printer comprising a mechanism mounting section able to attach plural image forming sections; a color information obtaining section to obtain color information informing kind of coloring material contained in each of said plural image forming sections attached at each prescribed position of said mechanism mounting section, an image generating section to generate each image data corresponding to each of said plural image forming sections, based on said image information.

DESCRIPTION OF THE PREFERRED EMBODIMENTS

Embodiment 1

<Configuration>

Figure 1:
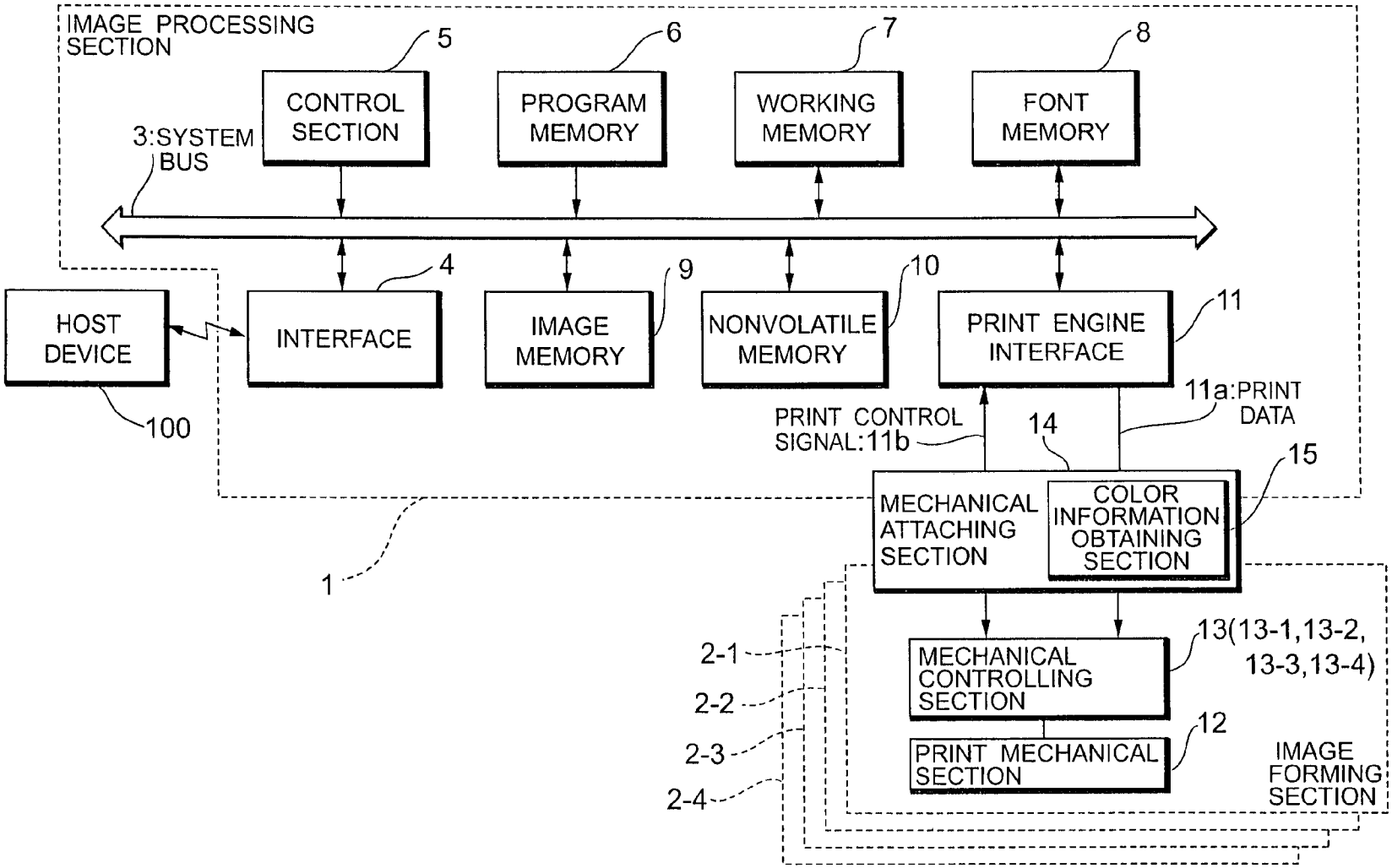
FIG. 1 is a block diagram showing configuration of Embodiment 1.

FIG. 1 is a block diagram showing configuration of Embodiment 1.

As shown in FIG. 1, printing apparatus of Embodiment 1 includes an image processing section 1 and four image forming sections 2-1, 2-2, 2-3, 2-4 and a mechanical attaching section 14.

The image forming section 1 is a section to make image data from image information received from a host device 100, and to send the image data to the image forming sections 2-1, 2-2, 2-3, 2-4. For this purpose, the image forming section 1 comprises a system bus 3, an interface 4, a control section 5, a program memory 6, a working memory 7, a font memory 8, an image memory 9, a nonvolatile memory and a print engine interface 11.

The system bus 3 is a section for receiving image information from the host device 100 through the interface 4. And, all of other parts are connected with this system bus 3.

The interface 4 is a parallel interface connecting the host device 100 with the system bus 3. An example of this is RS232C or LAN (Local Area Network) etc.

The control section 5 is a section to make image data and to send image data of each prescribed color, to each of the image forming sections 2-1, 2-2, 2-3, 2-4. Moreover, the control section 5 is a microprocessor as well, so as to perform overall control of the printing apparatus.

The program memory 6 is a ROM (Read Only Memory) to contain beforehand, program executed in the control section 5.

The working memory 7 is a RAM (Random Access Memory) to contain image information etc. received from the host device 100 through the interface 4.

The font memory 8 is a ROM to contain transforming code for transforming character code or other code included in the image information etc. received from the host device 100 through the interface 4, into bit-mapped font data for printing.

The image memory 9 is a RAM to contain, for example, one page of image data of each prescribed color, made in editing process performed by the control section 5. The image data of each prescribed color is read by the control section 5 from the image memory 9 corresponding to color information mentioned later, so as to send to corresponding one of image forming sections 2-1, 2-2, 2-3, 2-4.

The nonvolatile memory 10 is a section to memorize initializing information of the printing apparatus, information to be base of each judgement performed by the control section 5, user information, each correcting value etc. And, it is a nonvolatile memory element able to keep memory even while electricity supply is turned off. The color information mentioned later is memorized in this section as well.

The print engine interface 11 is an interface to mediate print data 11*a* or print control signal 11*b* between the image processing section 1 and the image forming sections 2-1, 2-2, 2-3, 2-4.

The image forming sections 2-1, 2-2, 2-3, 2-4 have configurations able to attach and to detach. And, each of them are sections to reproduce an image on a print sheet, with receiving image data (print data) of each color from the image processing section 1. For this purpose, each of them comprise a print mechanical section 12 and a mechanical controlling section 13.

The print mechanical section 12 is a mechanical section to reproduce an image on a print sheet, with receiving an image data. And, each one of print mechanical section 12 is provided in each of image forming sections 2-1, 2-2, 2-3, 2-4. Here, with referring to the other drawing, outline configuration of the print mechanical section 12 will be described.

Figure 2:
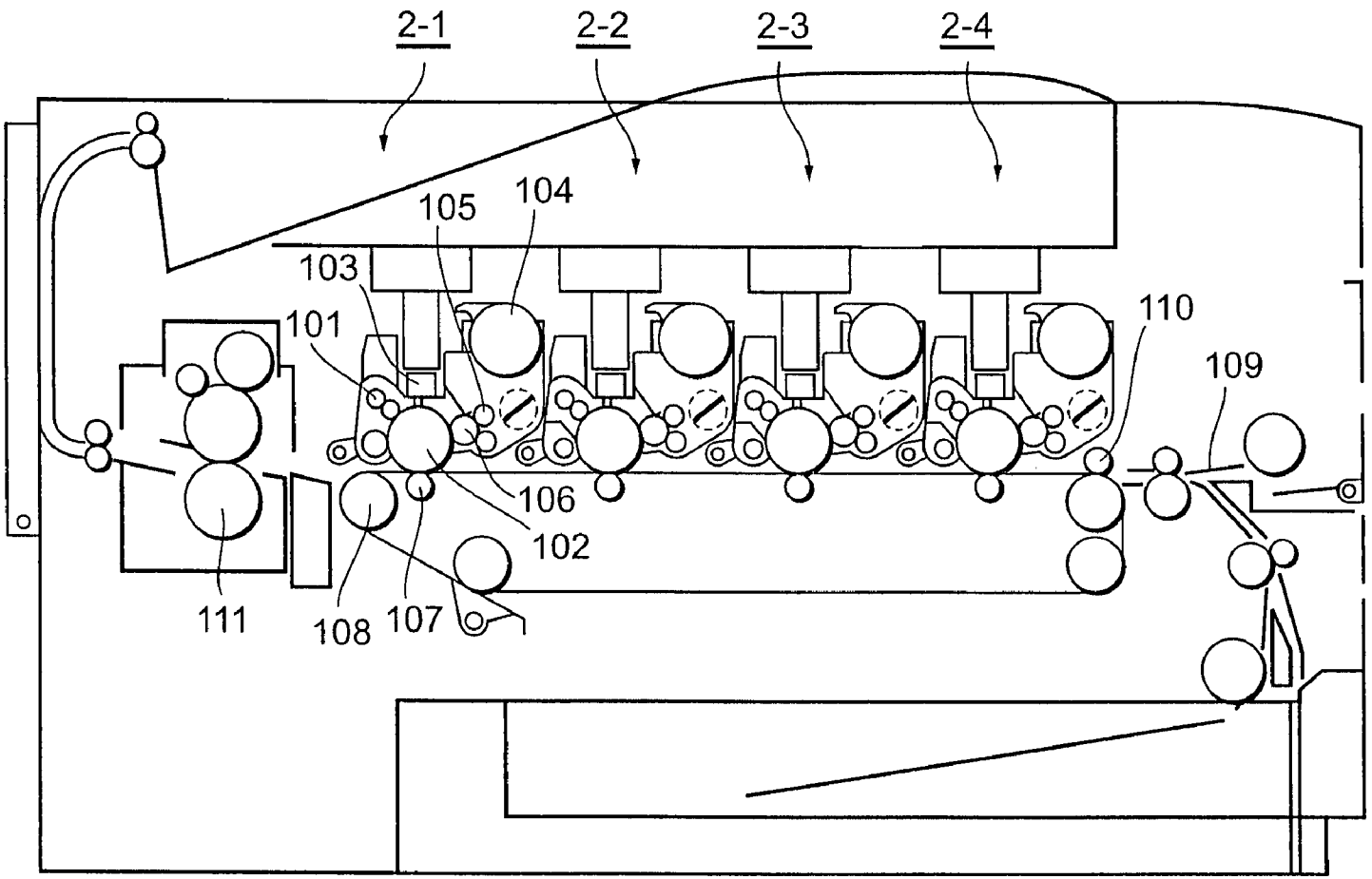
FIG. 2 is a horizontal sectional view showing a configuration of a printer including a chief portion of print mechanical section.

FIG. 2 is a horizontal sectional view showing an internal configuration of a printing apparatus, including four image forming sections 2-1, 2-2, 2-3, 2-4.

In FIG. 2, a charging roller 101 is a section to charge negative electric charge on surface of photosensitive drum 102. The photosensitive drum 102 is a rotating drum spread with photosensitive material on surface of metallic cylinder such as aluminum cylinder etc. This photosensitive drum 102 rotates clockwise. At first, surface of photosensitive drum 102 is charged negative uniformly by the charging roller 101.

Subsequently, a electrostatic latent image is formed by radiating light selectively on surface of photosensitive drum 102 with light source such as LED etc. Succeedingly, the electrostatic latent image is developed by supplying toner onto the surface of photosensitive drum 102 from a toner tank 104 containing charged toner, with using a conveying roller 105 and a developing roller 106. Toner which developed the electrostatic latent image, is transferred onto a print sheet 109 by a transferring roller 107. This print sheet 109 transcribed with an image formed by toner, is fixed with toner by a fixing roller 111. And, after all, the print sheet 109 is let out from the printing apparatus.

As described above, each print mechanical section 12 of image forming sections 2-1, 2-2, 2-3, 2-4, reproduce each color of Y, M, C, K in occasion of printing.

Back to FIG. 1 again, the mechanical controlling section 13 is installed in each of the image forming sections 2-1, 2-2, 2-3, 2-4 respectively. And, each of them are sections to control each of print mechanical sections 12 with receiving print data of each color 11*a* or print control signal 11*b*. Each print data (image data) is sent from the image processing section 1, as separated per each color of Y, M, C, K for each of the image forming sections 2-1, 2-2, 2-3, 2-4. According to a prescribed regulation, the mechanical controlling sections 13 (13-1, 13-2, 13-3, 13-4) receive image data of each color of Y, M, C, K per each color. Moreover, the mechanical controlling sections 13 are sections to send color information mentioned later, to the control section 5.

A mechanical attaching section 14 (mechanism mounting section) is a section to attach each of four image forming sections 2-1, 2-2, 2-3, 2-4 at different positions. This is a section enabling to combine an image processing section 1 and four image forming sections 2-1, 2-2, 2-3, 2-4 electrically and mechanically, so as to work as a printing apparatus. This mechanical attaching section 14 has a color information obtaining section 15.

A color information obtaining section 15 is a section to obtain color information indicating each color of four image forming sections 2-1, 2-2, 2-3, 2-4. As an example of color information, what is adopted is a system where each specific figure which is different about each color of Y, M, C, K is formed at each portion of attaching sections of the image forming sections 2-1, 2-2, 2-3, 2-4 between the image forming sections 2-1, 2-2, 2-3, 2-4 and the mechanical attaching section 14. And, when an image forming section is attached at a prescribed position of the mechanical attaching section 14, the mechanical attaching section 14 is able to judge the color of image forming section from the specific figure. This color information is sent via the mechanical controlling section 13, the print engine interface 11 and the system bus 3, to the control section 5. And, this color information is contained in the nonvolatile memory 10.

<Operation>

Operation of Embodiment 1 will be described.

Figure 3:
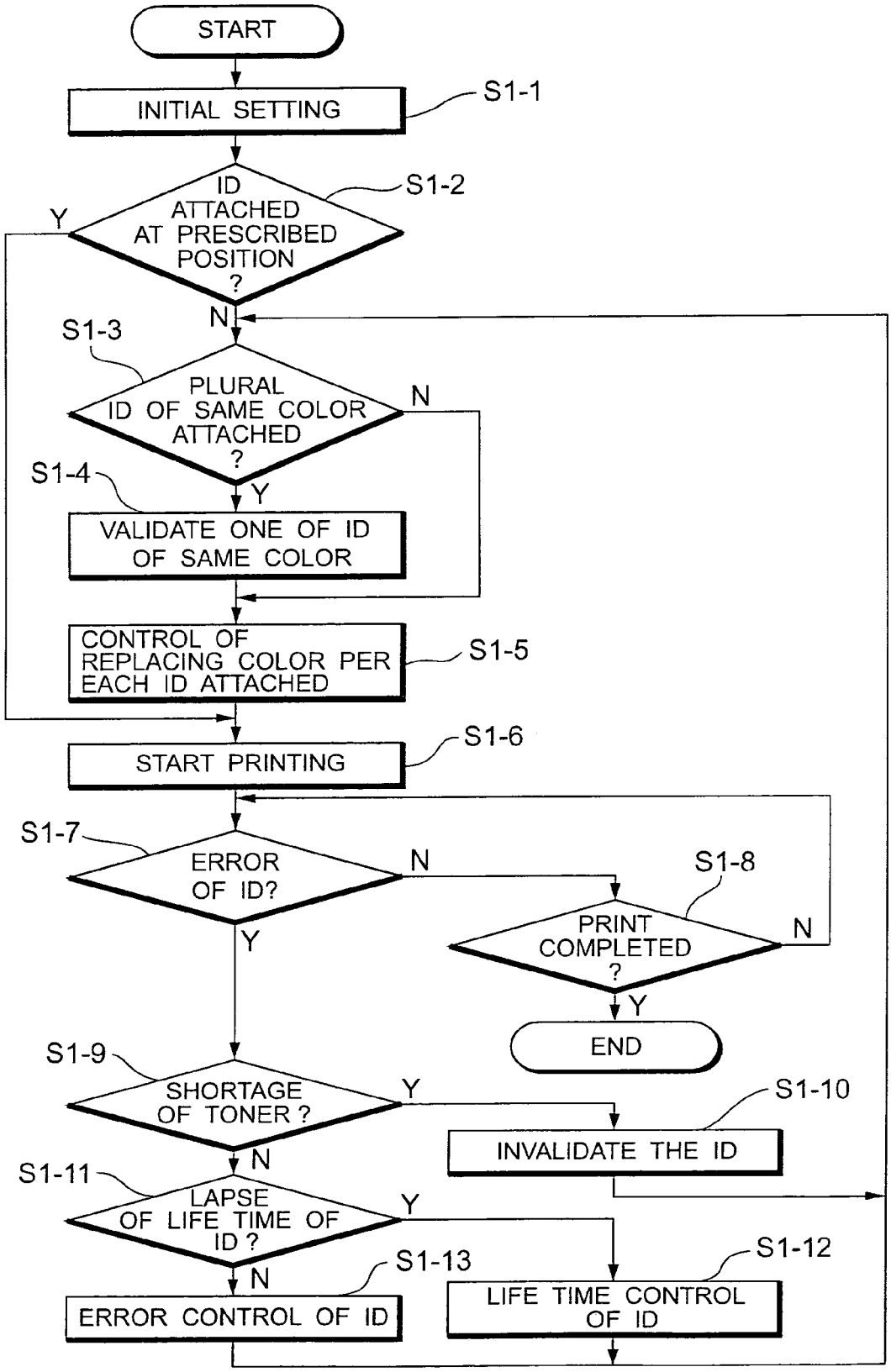
FIG. 3 is a flow chart showing operation of Embodiment 1.

FIG. 3 is a flow chart showing operation of Embodiment 1.

Hereafter, operation of Embodiment 1 will be described in order of step S1-1 to S1-13. Incidentally, a symbol "ID" is an abbreviation of image forming apparatus.

Step S1-1

The control section 5 (FIG. 1) performs an initial setting of the whole apparatus based on a prescribed program.

Step S1-2

The control section 5 (FIG. 1) detects whether all image forming sections are attached to all prescribed positions of the mechanical attaching section 14 (FIG. 1) or not, with receiving each control signal sent from each mechanical controlling section 13 (13-1, 13-2, 13-3, 13-4) (FIG. 1). Each control signal is included in the print control signal 11*b* (FIG. 1). And, each control signal contains information informing whether each image forming section is attached to each prescribed position of the mechanical attaching section 14 (FIG. 1) or not, and information of color obtained by the color information obtaining section 15 (FIG. 1). In case that all image forming sections of each color of Y, M, C, K are attached to four attaching positions of the mechanical attaching section 14 (FIG. 1) and that each prescribed color of image forming section is attached to each prescribed position decided beforehand, the control section 5 (FIG. 1) proceeds to step S1-6, so as to start printing. Otherwise, it proceeds to step S1-3.

Step S1-3

The control section 5 (FIG. 1), even when all (four) image forming sections are attached, checks whether plural image forming sections of the same color among the attached image forming sections are attached or not, with receiving each control signal sent from each mechanical controlling section 13 (13-1, 13-2, 13-3, 13-4) (FIG. 1). Moreover, the control section 5 (FIG. 1) checks whether prescribed color of image forming section is attached to position other than prescribed position decided beforehand or not. In case that plural image forming sections of the same color among the attached image forming sections are attached, the control section 5 (FIG. 1) proceeds to step S1-4. Otherwise, it proceeds to step S1-5.

Step S1-4

The control section 5 (FIG. 1) validates one of image forming sections of the same color, to operate, so as to perform printing. And, it invalidates other image forming sections of the same color, so as to exclude from object of control, and to keep in state of no operation.

Step S1-5

The control section 5 (FIG. 1) judges that four image forming sections are not attached to prescribed positions of the mechanical attaching section 14 (FIG. 1) and that some of them are attached to different positions. Then, it performs reassignment control of colors, so as to send a prescribed image data to a corresponding image forming section attached at different position. That is, the control section 5 (FIG. 1) makes an image data on the image memory 9 (FIG. 1) based on color information. And, it sends each image data corresponding to color information, to each of image forming sections. For example, suppose a case that, among the attaching positions of mechanical attaching section 14 (FIG. 1), an image forming section of black K is attached to a position where an image forming section of cyan C is originally expected to be attached. And, an image forming section of cyan C is attached to a position where an image forming section of black K is originally expected to be attached. In this case, an image data of black K is sent to a position where an image forming section of cyan C is originally expected to be attached. And, an image data of cyan C is sent to a position where an image forming section of black K is originally expected to be attached. This kind of control is performed.

Step S1-6

The control section 5 (FIG. 1) starts printing by sending image data to image forming sections 2-1, 2-2, 2-3, 2-4.

Step S1-7

The control section 5 (FIG. 1) watches occurrence of error signal of image forming sections by controlling the mechanical controlling section 13 (FIG. 1). As far as the error signal is not detected, the watching is continued by repeating step S1-8 and step S1-7. When the control section 5 (FIG. 1) received the error signal, it proceeds to step S1-9.

Step S1-8

The control section 5 (FIG. 1) continues to watch the error signal until printing is completed. When printing is completed, the process ends.

Step S1-9

When error signal is detected, the control section 5 (FIG. 1) detects quantity of toner inside of image forming section by controlling the mechanical controlling section 13 (FIG. 1). And, in case that quantity of toner decreased less than a prescribed quantity, it proceeds to step S1-10. Otherwise, it proceeds to step S1-11.

Step S-10

The control section 5 (FIG. 1) invalidates the image forming section, so as to make a state of no operation. After that, it proceeds to step S1-3. As a result, in case that plural image forming sections of the same color are included at step S1-3; the image forming section invalidated before in a former stage of preparing printing, is validated in this stage of preparing printing. And, printing process is continued at step S1-6, after the control of replacement of colors is performed at step S1-5, so as to make sure of positions of image forming sections.

Step S1-11

The control section 5 (FIG. 1) detects lapse of time in use of the image forming section by controlling the mechanical controlling section 13 (FIG. 1). And, in case that the lapse of time in use of the image forming section has come to the life time of the image forming section, it proceeds to step S1-12. Otherwise, it proceeds to step S1-13.

Step S1-12

The control section 5 (FIG. 1) invalidates the image forming section, so as to set a state of no operation. That is, what is performed is so called a life time control of an image forming section. After that, the control returns to step S1-3. As a result, in case that plural image forming sections of the same color are included at step S1-3; the image forming section invalidated in a former stage of preparing printing, is validated in this stage of preparing printing. And, printing process is continued at step S1-6, after the control of replacement of colors is performed at step S1-5, so as to make sure of positions of image forming sections.

Step S1-13

The control section 5 (FIG. 1) invalidates the image forming section, so as to set a state of no operation. That is, what is performed is so called an error control of an image forming section. After that, the control returns to step S1-3. As a result, in case that plural image forming sections of the same color are included at step S1-3; the image forming section invalidated in a former stage of preparing printing, is validated in this stage of preparing printing. And, printing process is continued at step S1-6, after the control of replacement of colors is performed at step S1-5, so as to make sure of positions of image forming sections.

In above description, the color information obtaining section 15 has each specific figure different per each color of Y, M, C, K at each portion of image forming section's side between the image forming section 2-1 to 2-4 and mechanical attaching section 14. And, the control section 5 is able to judge the color as soon as the mechanical attaching section 14 accepted the image forming section 2-1 to 2-4. However, the present invention is not limited to this Embodiment. For example, each resistor for detecting is placed at each portion of electrical connecting section of image forming section 2-1 to 2-4 per each color of Y, M, C, K. And, the control section 5 is able to judge the color by detecting each value of the resistor. Moreover, layout of the color information obtaining section 15 is not limited to inside of the mechanical attaching section 14. It can be placed wherever as far as necessary data can be obtained. Further, in the description mentioned above, color information is contained in a nonvolatile memory 10. However, the present invention is not limited to this Embodiment. That is, the color information can be contained in an area of the working memory 7.

<Effects>

As described above, in Embodiment 1, a color information obtaining section is provided. And, when it is detected that plural image forming sections of the same color are attached to a printing apparatus, based on color information obtained by the color information obtaining section; the control section validates only one of the plural image forming sections. And, the rest of the plural image forming sections of the same color are invalidated, so as to exclude from object of control. Thereby, obtained is an effect that the printing apparatus is enabled to operate, even when a prescribed image forming section is not attached to a prescribed attaching position. Moreover, when it is detected that an image forming section is attached to position other than prescribed position decided beforehand, control of replacement of colors is performed so that a prescribed image signal is sent to a prescribed image forming section. Thereby, obtained is an effect that the printing apparatus is enabled to operate, even when a prescribed image forming section is not attached to a prescribed attaching position and this image forming section is going to operate. Further, since it becomes possible to attach plural image forming sections of the same color; obtained is an effect that it becomes possible to make a printing apparatus which is able to perform continuous printing with large quantity.

Embodiment 2

<Configuration>

In electrophotographic printer of Embodiment 2, an up and down mechanism is provided, so as to lift either of image forming sections by a prescribed height. Thus, it becomes able to avoid mechanical contact with the mechanical attaching section. By providing this mechanism, it becomes possible to keep a state avoiding contact with the mechanical attaching section, by lifting the invalidated image forming section up, in the occasion when plural image forming sections of the same color are attached in Embodiment 1 mentioned above. Then, it becomes possible to save image forming sections not used yet, from getting old, before getting into use. In order to achieve this object, printing apparatus of Embodiment 2 comprises as follows.

Figure 4:
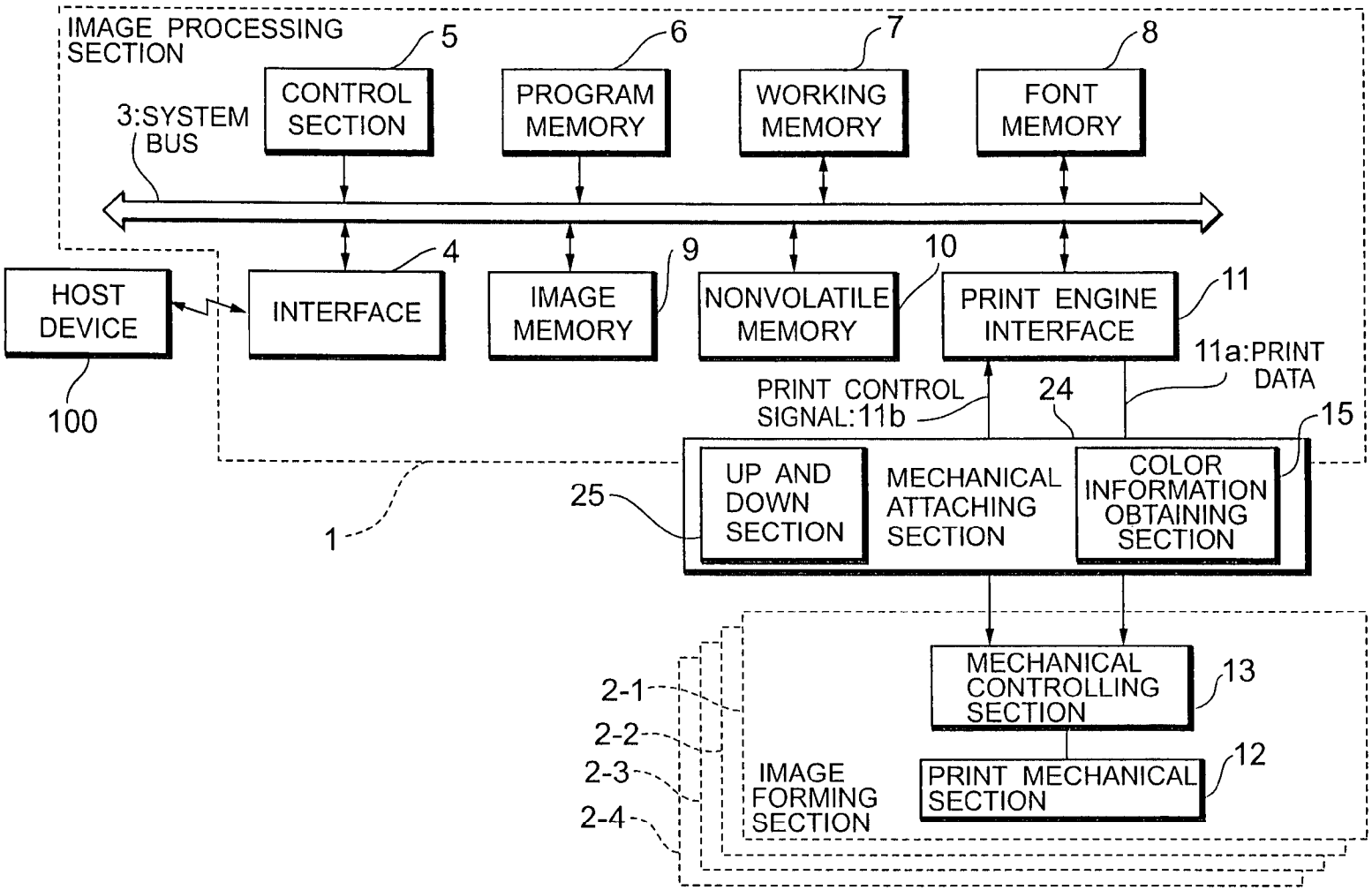
FIG. 4 is a block diagram showing configuration of Embodiment 2.

FIG. 4 is a block diagram showing configuration of Embodiment 2.

As shown in FIG. 4, printing apparatus of Embodiment 2 includes an image processing section 1 and four image forming sections 2-1, 2-2, 2-3, 2-4 and a mechanical attaching section 24.

Hereafter, only sections different from Embodiment 1, will be described.

A mechanical attaching section 24 (mechanism mounting section) is a section to attach each of four image forming sections 2-1, 2-2, 2-3, 2-4 to the printing apparatus. This is a section enabling to operate as a printing apparatus combining an image processing section 1 and four image forming sections 2-1, 2-2, 2-3, 2-4 electrically and mechanically. This mechanical attaching section 24 has an up and down section 25 together with a color information obtaining section 15.

The up and down section 25 is a means to lift prescribed image forming section by prescribed height for purpose of avoiding contact with the mechanical attaching section 24. This mechanism is performed by driving a drive motor (not shown in the drawings) included in the mechanical attaching section 24 and controlled by the mechanical controlling section 13 based on control of control section 5. That is, this is a mechanism used in the occasion when the control section 5 detects that plural image forming sections of the same color are attached to a printing apparatus, based on color information obtained by the color information obtaining section 15; and it validates only one of the plural image forming sections 2-1 to 2-4, and it invalidates the rest of the plural image forming sections of the same color so as to exclude from object of control.

As for other elements, they all are same as Embodiment 1. Therefore, the same description is omitted.

<Operation>

Subsequently, difference of operation between Embodiment 2 and 1 will be described.

Figure 5:
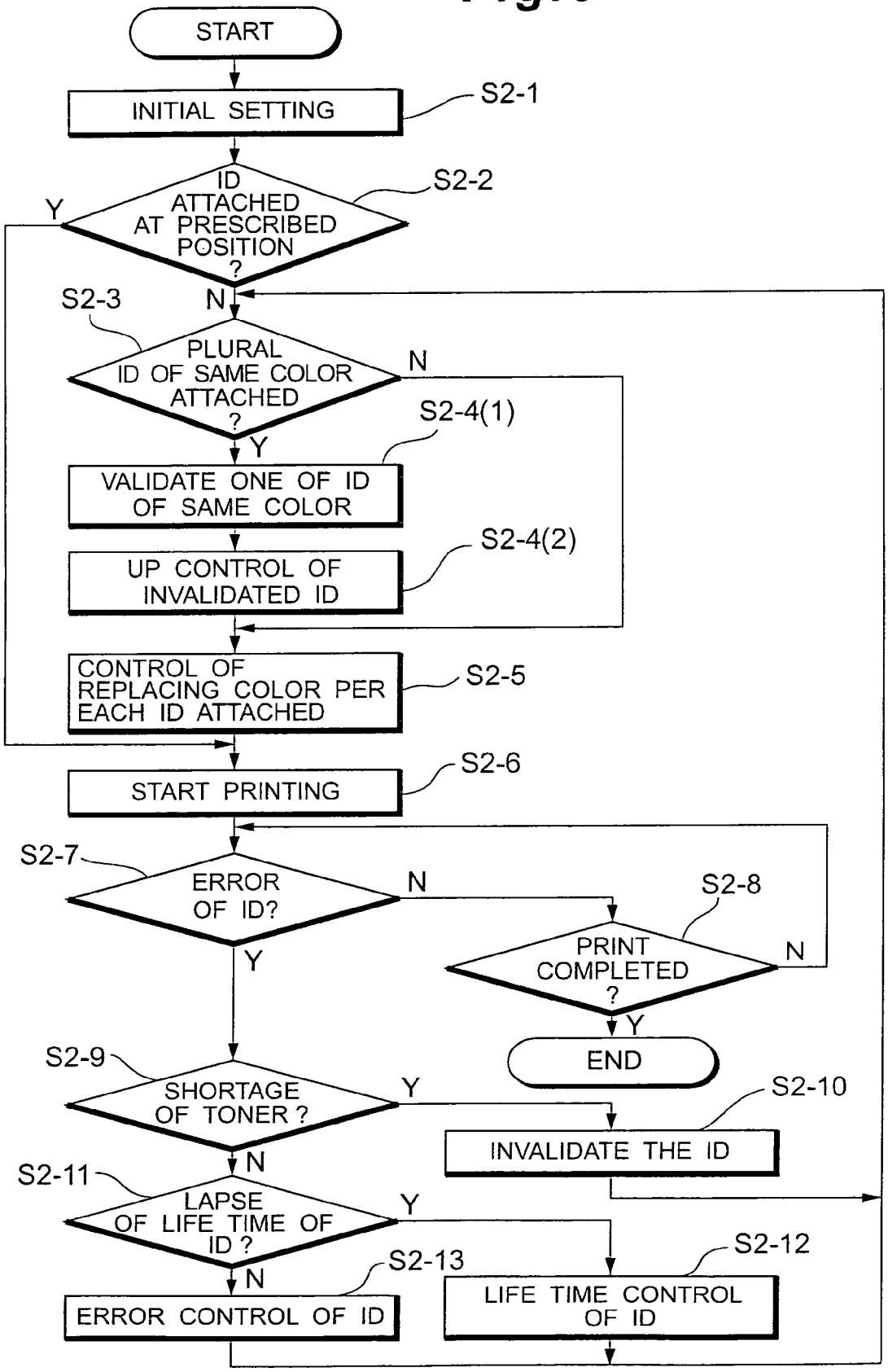
FIG. 5 is a flow chart showing operation of Embodiment 2.

FIG. 5 is a flow chart showing operation of Embodiment 2.

Hereafter, operation of Embodiment 2 is described in order of step S2-1 to S2-13. Incidentally, a symbol "ID" is an abbreviation of image forming apparatus.

The steps S2-1 to S2-4(1) are same as the steps S1-1 to S1-4 of Embodiment 1.

Step S2-4(2)

The control section 5 (FIG. 4), based on color information, lifts image forming sections to be invalidated and excluded from control object, up by a prescribed height, with driving the up and down section 25 included in the mechanical attaching section 24 (FIG. 4), under control of the mechanical controlling section 13 (FIG. 4), so as to avoid contact with the mechanical attaching section 24.

The steps S2-5 to S2-13 are same as the steps S1-5 to S1-13 of Embodiment 1.

In the description mentioned above, described is only a case that image forming sections are lifted with a prescribed height, so as to avoid contact with the mechanical attaching section 24. However, the present invention is not limited to this Embodiment. That is, for example, in the occasion when image forming sections are made up of ink jet devices, to avoid aging of ink jet devices, what is adopted is a method of stuffing nozzles etc.

<Effects>

As described above, an up and down mechanism is provided so as to lift prescribed image forming sections by a prescribed height avoiding contact with the mechanical attaching section. Thereby, it becomes possible to keep a state avoiding contact with the mechanical attaching section, by lifting the invalidated image forming sections up. Then, obtained is an effect that it becomes possible to save image forming sections not used yet, from getting old, before getting into use.

Embodiment 3

<Configuration>

In Embodiment 1, control of replacement of colors was performed by the control section, in the occasion when image forming sections of prescribed colors are not attached at prescribed positions of the mechanical attaching section decided beforehand. In Embodiment 3, an image data distributing section is provided between the image processing section and the image forming sections. This image data distributing section, when it received image data, distributes the image data, based on a rule of distributing image data, to each of plural image forming sections. Moreover, the rule of distributing image data is decided by the control section. In this way, obtained is an effect same as Embodiment 1. In order to achieve this object, printing apparatus of Embodiment 3 comprises as follows.

Figure 6:
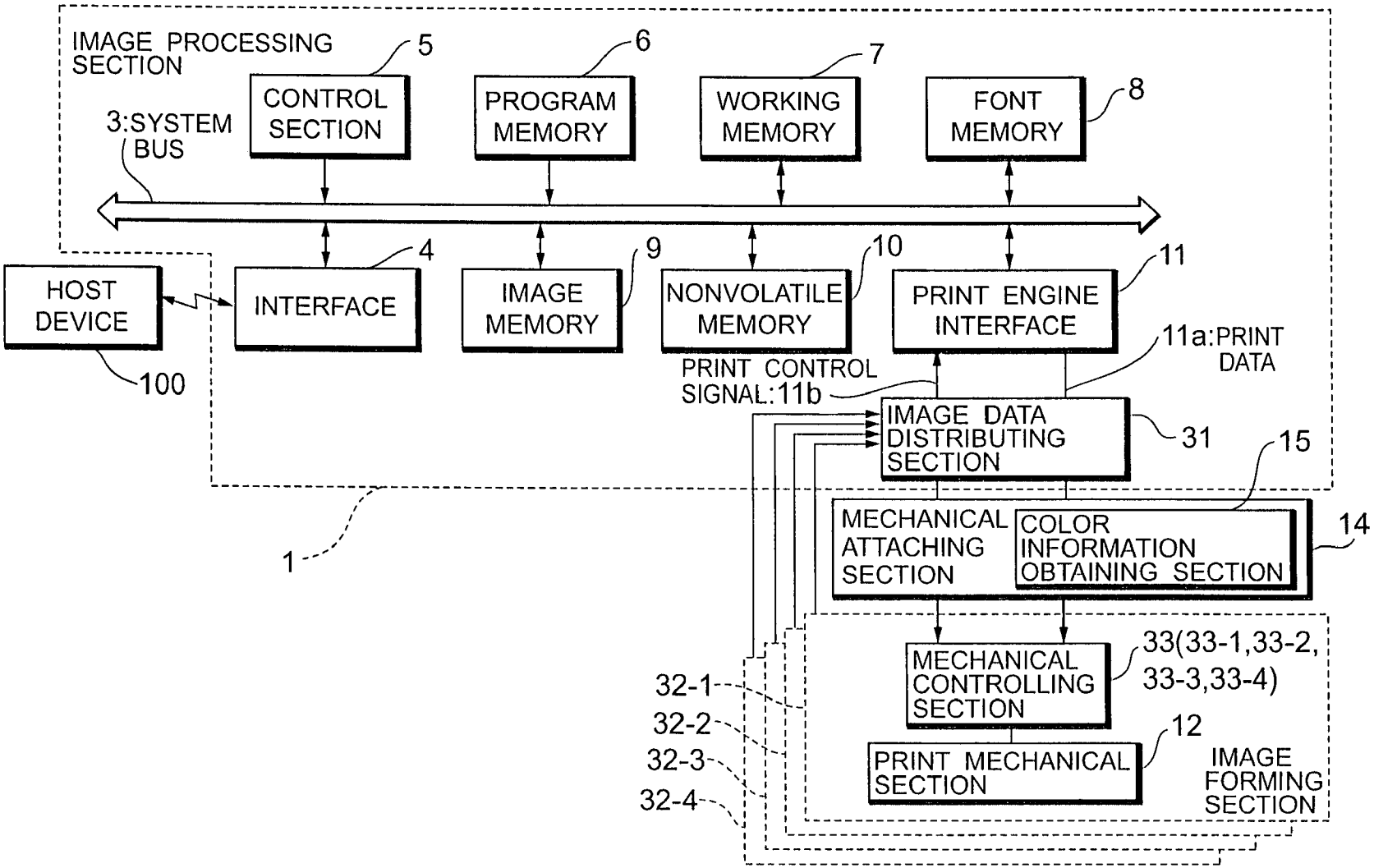
FIG. 6 is a block diagram showing configuration of Embodiment 3.

FIG. 6 is a block diagram showing configuration of Embodiment 3.

As shown in FIG. 6, printing apparatus of Embodiment 3 includes an image processing section 1, an image data distributing section 31 and four image forming sections 32-1, 32-2, 32-3, 32-4 and a mechanical attaching section 14.

Only difference with Embodiment 1 is described.

An image data distributing section 31 is a section provided between the image processing section 1 and the image forming sections 32-1, 32-2, 32-3, 32-4. This image data distributing section 31 distributes the image data, based on a rule of distributing image data, to each of plural image forming sections 32-1, 32-2, 32-3, 32-4.

The image forming sections 32-1, 32-2, 32-3, 32-4 are sections to reproduce images on print sheets, with receiving image data (print data) from the image processing section 1. For this purpose, they comprise print mechanical section 12 and mechanical controlling section 33.

The mechanical controlling section 33 is a section to control the print mechanical section 12 with receiving print data of each color 11*a* or print control signal 11*b*. Moreover, it is a section to set rule of distributing image data mentioned above, based on color information. The other elements are same as Embodiment 1. So, the same description is omitted.

The difference with Embodiment 1 of Embodiment 3 will be described in detail, referring to the other drawing.

Figure 7:
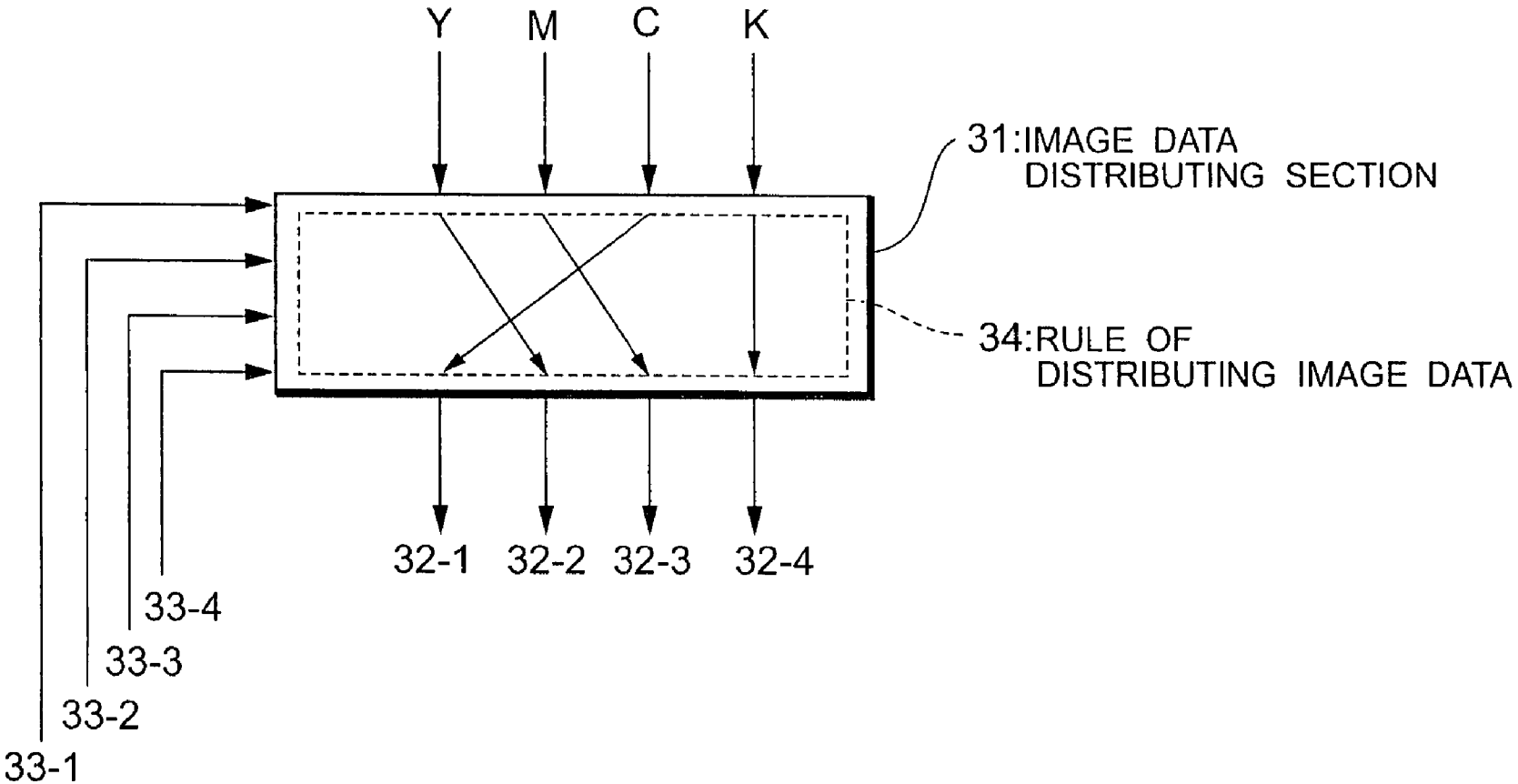
FIG. 7 is a view showing configuration of image data distributing section.

FIG. 7 is a sketch showing configuration of image data distributing section 31.

As shown in FIG. 7, the image data distributing section 31 is a section to receive image data per each color of Y, M, C, K from the control section 5 (FIG. 6) via print engine interface 11 (FIG. 6), and to distribute the image data to each of plural image forming sections 32-1, 32-2, 32-3, 32-4, based on a rule 34 of distributing image data.

Arrows inside a dotted frame in FIG. 7 represent functions of the rule 34 of distributing image data. In an example of FIG. 7, the rule 34 of distributing image data, decides to distribute image data of color Y to image forming section 32-2, image data of color M to image forming section 32-3, image data of color C to image forming section 32-1, and image data of color K to image forming section 32-4.

This rule 34 of distributing image data, is decided by the control section 5, and set by the mechanical controlling section 33.

As described before, color information is sent to the control section 5 by way of mechanical controlling sections 33-1, 33-2, 33-3, 33-4, print engine interface 11 and system bus 3. The control section 5 decides arrows shown in the drawing, based on the color information. And, it informs each of mechanical controlling sections 33-1, 33-2, 33-3, 33-4, of information of distribution. Each of mechanical controlling sections 33-1, 33-2, 33-3, 33-4 set each arrow shown in the drawing, based on this information of distribution.

<Operation>

Operation of Embodiment 3 will be described.

Figure 8:
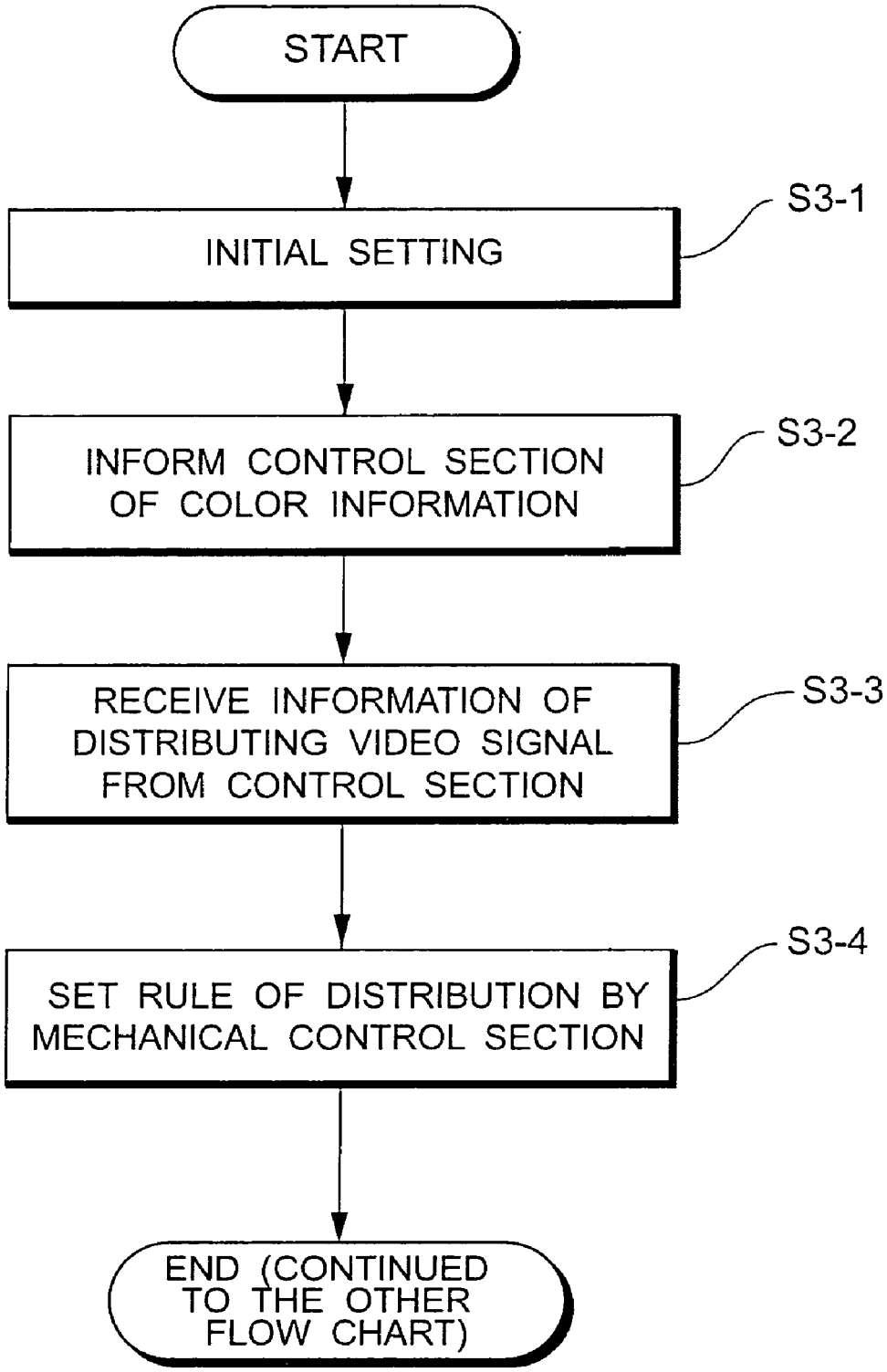
FIG. 8 is a flow chart showing operation of Embodiment 3.

FIG. 8 is a flow chart showing operation of Embodiment 3.

Hereafter, operation of Embodiment 3 is described in order of step S3-1 to S3-4. Incidentally, a symbol "ID" is an abbreviation of image forming apparatus.

Step S3-1

The control section 5 (FIG. 6) performs an initial setting of the whole apparatus based on a prescribed program.

Step S3-2

The color information is sent to the control section 5 (FIG. 6) by way of mechanical controlling sections 33-1, 33-2, 33-3, 33-4 (FIG. 6), print engine interface 11 (FIG. 6) and system bus 3 (FIG. 6). The control section 5 (FIG. 6) decides rule of distribution (FIG. 7), based on the color information.

Step S3-3

The control section 5 (FIG. 6) informs mechanical controlling section 33 (FIG. 6), of information of rule 34 (FIG. 7) of distributing image data. The mechanical controlling sections 33 (FIG. 6) receives this information of distribution, from the control section 5 (FIG. 6).

Step S3-4

The mechanical controlling section 33 (FIG. 6) sets rule 34 (FIG. 7) of distributing image data. And, all processes in the flow chart end.

In the description mentioned above, the control section 5 (FIG. 6) decides rule 34 (FIG. 7) of distributing image data. However, the present invention is not limited to this Embodiment. That is, as described before, color information is sent to the control section 5 by way of mechanical controlling sections 33-1, 33-2, 33-3, 33-4, print engine interface 11 and system bus 3. Therefore, each of mechanical controlling sections 33-1, 33-2, 33-3, 33-4 recognize, at which position of mechanical attaching section 14, attached is either of the image forming sections 32-1, 32-2, 32-3, 32-4 that each of mechanical controlling sections 33-1, 33-2, 33-3, 33-4 belong.

Based on this recognition, each of mechanical controlling sections 33-1, 33-2, 33-3, 33-4 can decide rule 34 (FIG. 7) of distributing image data for itself, so as to receive prescribed image data needed by either of the image forming sections 32-1, 32-2, 32-3, 32-4 that each of mechanical controlling sections 33-1, 33-2, 33-3, 33-4 belong. Moreover, the flow chart of Embodiment 3 does not include processes such as error of image forming section, shortage of toner, lapse of life time etc. mentioned in Embodiment 1. However, these processes can be added to process of Embodiment 3 as well.

<Effects>

As described above, in Embodiment 3, an image data distributing section is provided between the image processing section and the image forming sections, so as to receive image data and to distribute the image data to either of plural image forming sections, based on rule of distributing image data. And, the control section decides the rule of distributing image data. Thereby, the same effect as Embodiment 1 is obtained.

Embodiment 4

<Configuration>

In Embodiment 4, in case that prescribed image forming section having prescribed color is not attached to the mechanical attaching section mentioned above, the control section informs the host device that a prescribed color is not able to appear. And, the succeeding processes are performed only after receiving admission from the host device. In this way, the printing apparatus is able to avoid to print an image which color does not accord with image information (color information) sent by the host device. In order to achieve this object, printing apparatus of Embodiment 4 comprises as follows.

<Operation>

The configuration of Embodiment 4 becomes completely same as Embodiment 1 (FIG. 1). Therefore, operation of Embodiment 4 will be described.

Figure 9:
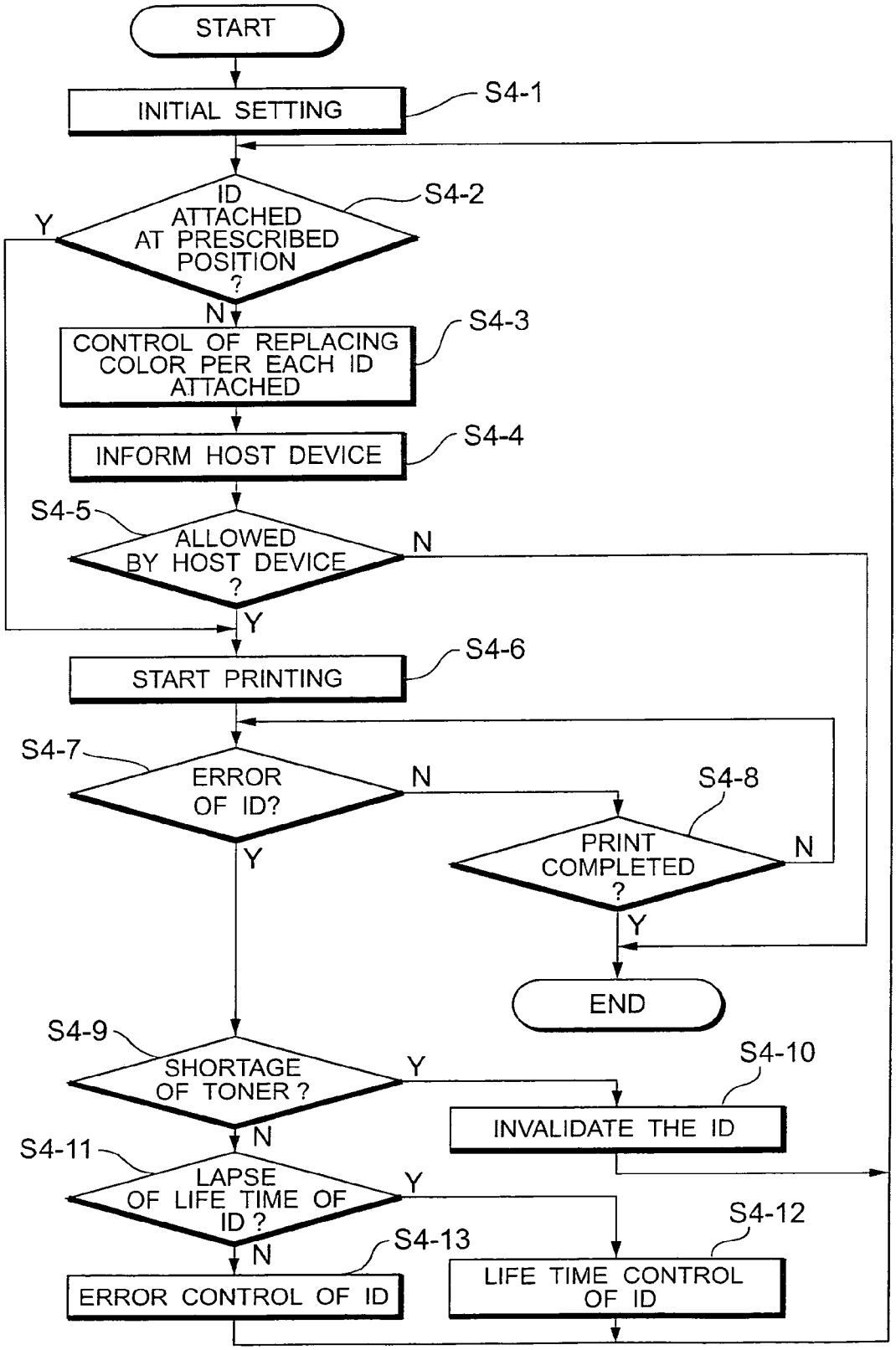
FIG. 9 is a flow chart showing operation of Embodiment 4.

FIG. 9 is a flow chart showing operation of Embodiment 4.

Hereafter, operation of Embodiment 4 is described in order of step S4-1 to S4-13. Incidentally, a symbol "ID" is an abbreviation of image forming apparatus.

Step S4-1

The control section 5 (FIG. 1) performs an initial setting of the whole apparatus based on a prescribed program.

Step S4-2

The control section 5 (FIG. 1) detects whether all image forming sections are attached to each prescribed positions of the mechanical attaching section 14 (FIG. 1) or not, with receiving each control signal sent from each mechanical controlling section 13 (FIG. 1). Each control signal is included in the print control signal 11*b* (FIG. 1). And, each control signal contains information informing whether each image forming section is attached to each prescribed position of the mechanical attaching section 14 (FIG. 1) or not, and information of color obtained by the color information obtaining section 15 (FIG. 1). In case that all image forming sections of each color of Y, M, C, K are attached to four attaching positions of the mechanical attaching section 14 (FIG. 1) and that prescribed color of image forming section is attached to prescribed position decided beforehand, the control section 5 (FIG. 1) jumps to step S4-6, so as to start printing. Otherwise, it proceeds to step S4-3.

Step S4-3

The control section 5 (FIG. 1) judges that four image forming sections are not attached to prescribed positions of the mechanical attaching section 14 (FIG. 1) and that some of them are attached to different positions. Or, it judges that prescribed image forming section of a prescribed color is not attached to anywhere. Then, it performs reassignment control of colors, so as to send a prescribed image data to a corresponding image forming section attached at different position.

Step S4-4

The control section 5 (FIG. 1) informs the host device of a result about the reassignment control of colors mentioned above (including result that prescribed image forming section of a prescribed color is not attached to anywhere).

Step S4-5

The control section 5 (FIG. 1) waits for allowance of printing informed from the host device 100. In case that allowance of printing informed from the host device 100 does not come, the process of flow chart ends, without performing printing. Contrary, allowance of printing informed from the host device 100 comes, the process proceeds to step S4-6. In case that the process of flow chart ends without performing printing, the fact is informed to the operator with an operation panel (not shown in the drawings) etc.

Step S4-6

The control section 5 (FIG. 1) starts printing by sending image data to image forming sections 2-1, 2-2, 2-3, 2-4.

Steps S4-7 to S4-9 are same as steps S1-7 to S1-9 of Embodiment 1. So, the same description is omitted.

Step S4-10

The control section 5 (FIG. 1) invalidates the image forming section, so as to make a state of no operation. After that, it proceeds to step S4-2. As a result, succeeding steps from step S4-3 are performed again. After all, the process comes to the end of flow chart.

Description of step S4-11 is omitted, as it is same as step S1-11 of Embodiment 1.

Step S4-12

The control section 5 (FIG. 1) invalidates the image forming section, so as to set a state of no operation. That is, what is performed is so called a life time control of an image forming section. After that, the control returns to step S4-2. As a result, succeeding steps from step S4-3 are performed again. After all, the process comes to the end of flow chart.

Step S4-13

The control section 5 (FIG. 1) invalidates the image forming section, so as to set a state of no operation. That is, what is performed is so called an error control of an image forming section. After that, the control returns to step S4-2. As a result, succeeding steps from step S4-3 are performed again. After all, the process comes to the end of flow chart.

<Effects>

As described above, in Embodiment 4, in case that prescribed image forming section having prescribed color is not attached to the mechanical attaching section, the control section informs the host device that a prescribed color is not able to appear. And, the succeeding processes are performed only after receiving admission from the host device. Thereby, an effect that the printing apparatus is able to avoid to print an image which color does not accord with image information (color information) sent by the host device, is obtained.

Embodiment 5

<Configuration>

In Embodiment 5, after control of reassignment of colors is performed, a correction from deviation of color registration is performed, based on position and color of image forming section after control of reassignment of colors. In this way, a clear image can be obtained, even after control of reassignment of colors. Here, a correction from deviation of color registration is a correction to adjust each position of images of each color, in order to keep a state matching them all completely, in the occasion when images of each colors are reproduced on a print sheet.

<Operation>

The configuration of Embodiment 5 becomes completely same as Embodiment 1 (FIG. 1). Therefore, operation of Embodiment 5 will be described.

Figure 10:
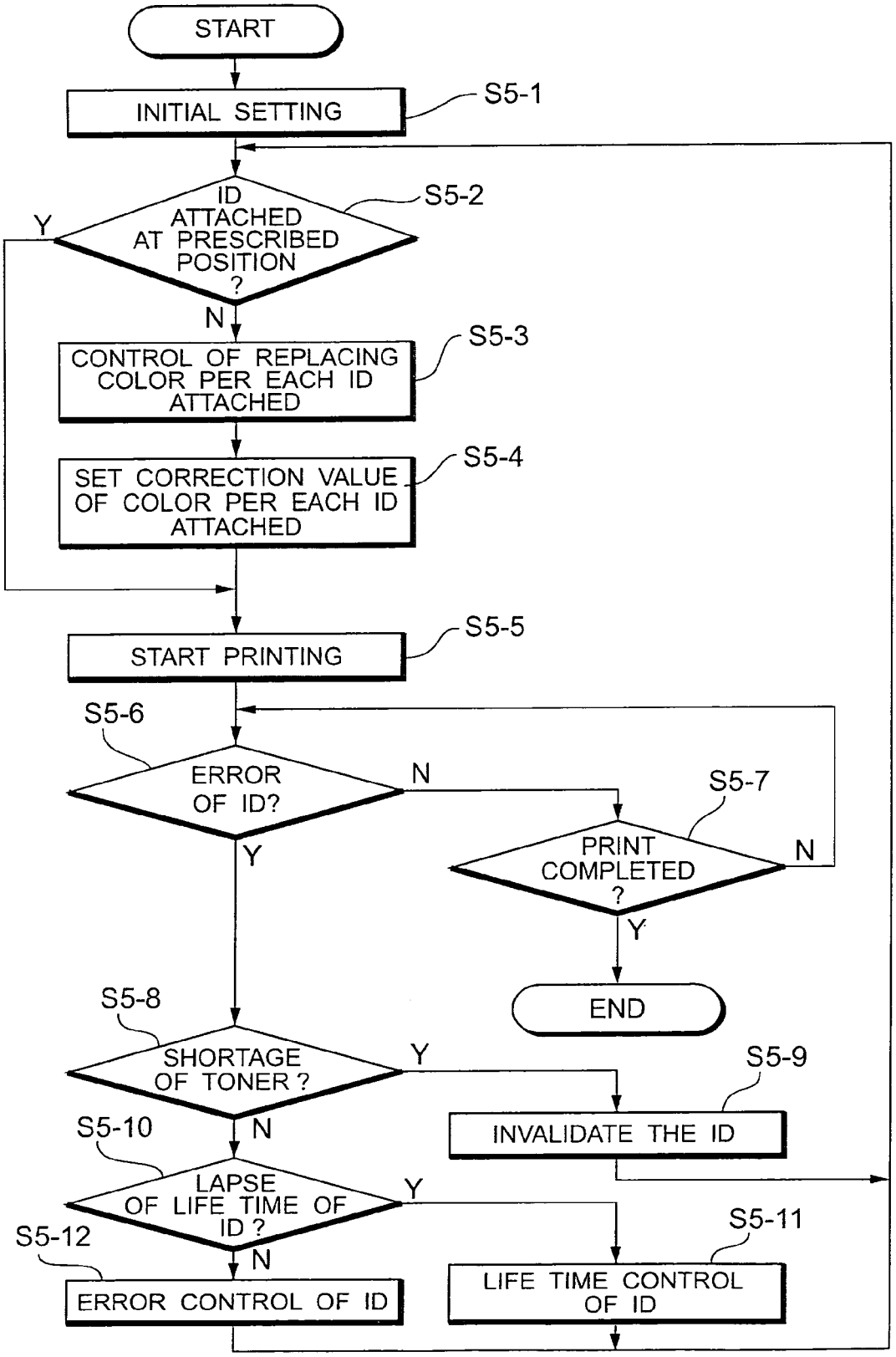
FIG. 10 is a flow chart showing operation of Embodiment 5.

FIG. 10 is a flow chart showing operation of Embodiment 5.

Hereafter, operation of Embodiment 5 is described in order of step S5-1 to S5-12. Incidentally, a symbol "ID" is an abbreviation of image forming apparatus.

Step S5-1

The control section 5 (FIG. 1) performs an initial setting of the whole apparatus based on a prescribed program.

Step S5-2

The control section 5 (FIG. 1) detects whether all image forming sections are attached to each prescribed positions of the mechanical attaching section 14 (FIG. 1) or not, with receiving each control signal sent from each mechanical controlling section 13 (FIG. 1). Each control signal is included in the print control signal 11*b* (FIG. 1). And, each control signal contains information informing whether each image forming section is attached to each prescribed position of the mechanical attaching section 14 (FIG. 1) or not, and information of color obtained by the color information obtaining section 15 (FIG. 1). In case that all image forming sections of each color of Y, M, C, K are attached to four attaching positions of the mechanical attaching section 14 (FIG. 1) and that prescribed color of image forming section is attached to prescribed position decided beforehand, the control section 5 (FIG. 1) jumps to step S5-5, so as to start printing. Otherwise, it proceeds to step S5-3.

Step S5-3

The control section 5 (FIG. 1) judges that four image forming sections are not attached to prescribed positions of the mechanical attaching section 14 (FIG. 1) and that some of them are attached to different positions. Or, it judges that prescribed image forming section of a prescribed color is not attached to anywhere. Then, it performs reassignment control of colors, so as to send a prescribed image data to a corresponding image forming section attached at different position.

Step S5-4

The control section 5 (FIG. 1), based on a result of control of reassignment of colors, sets a correction value for correcting deviation of color registration, corresponding to each position of image forming section. And, the process proceeds to step S5-5. Here, a correction value for correcting deviation of color registration is a correction value used for adjusting each position of images of each color, in order to keep a state matching them all completely, in the occasion when images of each colors are reproduced on a print sheet.

Step S5-5

The control section 5 (FIG. 1) starts printing by sending image data to image forming sections 2-1, 2-2, 2-3, 2-4.

Steps S5-6 to S5-8 are same as steps S1-7 to S1-9 of Embodiment 1. So, the same description is omitted.

Step S5-9

The control section 5 (FIG. 1) invalidates the image forming section, so as to make a state of no operation. After that, it proceeds to step S5-2. As a result, succeeding steps from step S5-3 are performed again. After all, the process comes to the end of flow chart.

Description of step S5-10 is omitted, as it is same as step S1-11 of Embodiment 1.

Step S5-11

The control section 5 (FIG. 1) invalidates the image forming section, so as to set a state of no operation. That is, what is performed is so called a life time control of an image forming section. After that, the control returns to step S5-2. As a result, succeeding steps from step S5-3 are performed again. After all, the process comes to the end of flow chart.

Step S5-12

The control section 5 (FIG. 1) invalidates the image forming section, so as to set a state of no operation. That is, what is performed is so called an error control of an image forming section. After that, the control returns to step S5-2. As a result, succeeding steps from step S5-3 are performed again. After all, the process comes to the end of flow chart.

Incidentally, method or means for correcting deviation of color registration is a technique known well in the field of color photographic printer etc. from the time before this invention was made. So, description about this is omitted.

<Effects>

As described above, in Embodiment 5, after control of reassignment of colors is performed, a correction from deviation of color registration is performed, based on position and color of image forming section after control of reassignment of colors. Thereby, obtained is an effect that a clear image can be obtained, even after control of reassignment of colors.

Other Embodiments

In description mentioned above, each Embodiment is described, as limiting to color photographic printer. However, the present invention is not limited to this. That is, the present invention can be applied to facsimile or copy machine.

What is claimed is:

1. A printer comprising:

a mechanism mounting section which is able to attach plural image forming sections;

a color information obtaining section to obtain color information informing kind of coloring material contained in each of said plural image forming sections attached at each prescribed position of said mechanism mounting section; and an image processing section to generate each image data corresponding to each of said plural image forming sections, based on said image information, wherein when said image processing section detects that plural image forming sections having the same kind of coloring material exist among said plural image forming sections attached to said mechanism mounting section, the image processing section (i) validates one of the same kind of plural image forming sections, (ii) generates image data corresponding to the validated image forming section, and (iii) invalidates the rest of the same kind of plural image forming sections, so as to exclude the rest of the same kind of plural image forming sections out of object of generating image.

2. A printer according to claim 1 further comprising a control section that receives an error signal indicating that said one of the same kind of plural image forming sections validated is unable to print, and upon receipt of the error signal, the control section (i) invalidates the formerly validated image forming section so as to exclude the formerly validated image forming section out of object of generating image, (ii) validates one of the rest of the same kind of plural image forming sections to be an object of generating image, and (iii) generates image data corresponding to the validated image forming section, so as to enable continuous printing.

3. A printer according to claim 1 further comprising a control section that invalidates the rest of the same kind of plural image forming sections, so as to exclude the rest of the same kind of plural image forming sections out of object of generating image and to keep a state of no operation.

4. A printer comprising:

a plurality of image forming sections, each section having a predetermined position for installation;

a color information obtaining section which obtains respective color information to respectively correspond to the plurality of image forming sections; and a control section which judges whether each image forming section is installed in the corresponding predetermined position, and if it is in an error installation-position, performs a reassignment control to send corresponding image data to the image forming section on the error position.

5. A printer according to claim 4 wherein the plurality of image forming sections provide figure-portions with different figures respectively, and the color information obtaining section obtains the color information on the basis of the different figures.

6. A printer according to claim 4 wherein the plurality of image forming sections provide detecting resistors with different resistor values respectively, and the color information obtaining section obtains the color information on the basis of the different figures.

7. A printer according to claim 4 wherein each image forming section is attachable and detachable, and each image forming section includes a photosensitive drum and a developing unit.

8. A printer according to claim 4 wherein the developing unit includes a toner tank, a conveying roller, and a developing roller.

* * * * *